US005248059A

United States Patent [19]

Taite

[11] Patent Number: 5,248,059

[45] Date of Patent: Sep. 28, 1993

[54] LIQUID STORAGE TANK

[76] Inventor: Clifford Taite, 255 Harrow, Hampstead, Quebec, Canada, H3X 3X7

[21] Appl. No.: 938,205

[22] Filed: Sep. 1, 1992

[51] Int. Cl.[5] ..... B65D 25/18

[52] U.S. Cl. ..... 220/567; 220/476

[58] Field of Search ..... 220/484, 476, 567, 565

[56] References Cited

U.S. PATENT DOCUMENTS

| | | | |
|---|---|---|---|
| D. 41,220 | 3/1911 | Crane . | |
| D. 89,598 | 4/1933 | Stukes . | |
| D. 188,738 | 8/1960 | Voelz, Jr. . | |
| D. 205,448 | 8/1966 | Grove . | |
| D. 212,089 | 8/1968 | Pelfer . | |
| D. 240,530 | 7/1976 | Kubik . | |
| D. 259,437 | 6/1981 | Koga et al. . | |
| D. 324,138 | 2/1992 | Labonte . | |
| 686,954 | 11/1901 | Riley | 220/476 |
| 3,263,854 | 8/1966 | Powers | 220/476 |
| 4,775,066 | 10/1988 | Keppeler | 220/484 |

*Primary Examiner*—Joseph Man-Fu Moy
*Attorney, Agent, or Firm*—Diller, Ramik & Wight

[57] ABSTRACT

A space-saving oil tank for oil-fired appliances including a flat narrow tank having parallel front and rear walls spaced apart approximately 6 inches with a flange surrounding the rear wall to be mounted against a basement wall. Adjustable legs are provided on the bottom wall near the front wall thereof for supporting the tank.

3 Claims, 2 Drawing Sheets

LIQUID STORAGE TANK

BACKGROUND OF THE INVENTION

1. Field of the Invention

The present invention relates to a liquid reservoir, and more particularly, to a space-saving reservoir for a domestic oil appliance.

2. Description of the Prior Art

Most single and multiple family dwellings in Canada and in the northern part of the United States are equipped with central heating, requiring a fossil fuel furnace, or in certain cases, electricity, especially in areas where hydro-electricity is available. There are two major fossil fuels used, namely, natural gas and heating oil. In the former case, the natural gas, at least in a city environment, is piped directly to the individual dwelling. Heating oil is generally delivered by truck and stored in storage tanks within the dwelling. These storage tanks are rarely under 100 gallons (378.5 liters) capacity and thus require significant space in such dwellings.

As far as the heating oil industry is concerned, the necessity of a storage tank on site is a further obstacle to sales of oil-fired appliances and their products.

Houses constructed in cold climates, such as mentioned above, are usually constructed with basements, and these are often converted into recreation rooms or even bedrooms. At the same time, the oil tank must compete with the space available in the basement for the installation of same. On the other hand, great strides have been taken to reduce the size and appearance of the furnace in order to better fit within the basement. However, few solutions have been offered to reduce the space required by the oil tank. One proposal is illustrated in U.S. Pat. No. D-324,138, issued Feb. 25, 1992 to William Labonte. In this design patent, the fuel tank is shaped in the form of a work bench, presumably to be used in a basement to save space.

SUMMARY OF THE INVENTION

It is an aim of the present invention to provide a liquid storage tank which will reduce the otherwise useful space required in a room for such a tank.

It is a further aim of the present invention to provide a space-saving oil tank for use with domestic oil-fired appliances.

In a construction in accordance with the present invention, there is provided a liquid storage reservoir to be mounted against a building wall including an upstanding vessel having parallel planar front and rear walls, and bottom, end and top walls joining the front and rear walls, the rear wall being provided with flanges in the same plane as the rear wall. At least a pair of legs is provided on the bottom wall near the front wall for supporting the vessel when the vessel is mounted with the rear wall adjacent the building wall and fastener means for joining the flange to the building wall such that in use, the reservoir is mounted to the building wall supported partly by the legs.

In a more specific embodiment, the vessel has a capacity of at least 50 gallons, and the outer dimension between the front and rear walls is approximately 6 inches.

In a still more specific embodiment, the reservoir includes several vessels mounted against a building wall adjacent one another, and conduits extend between the end walls of respective vessels communicating one vessel to the other in series. Such a reservoir can be completely hidden from view by providing a finished dry wall sandwiching the reservoir between the dry wall and the building wall. The depth of the vessel or vessels making up the reservoir is such that very little usable space is taken up by the reservoir.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 2:
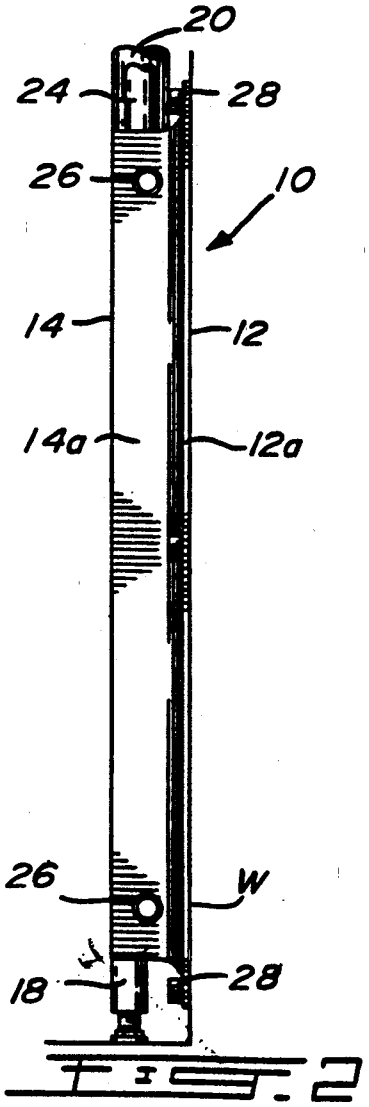
FIG. 2 is an end elevation thereof.
Figure 1:
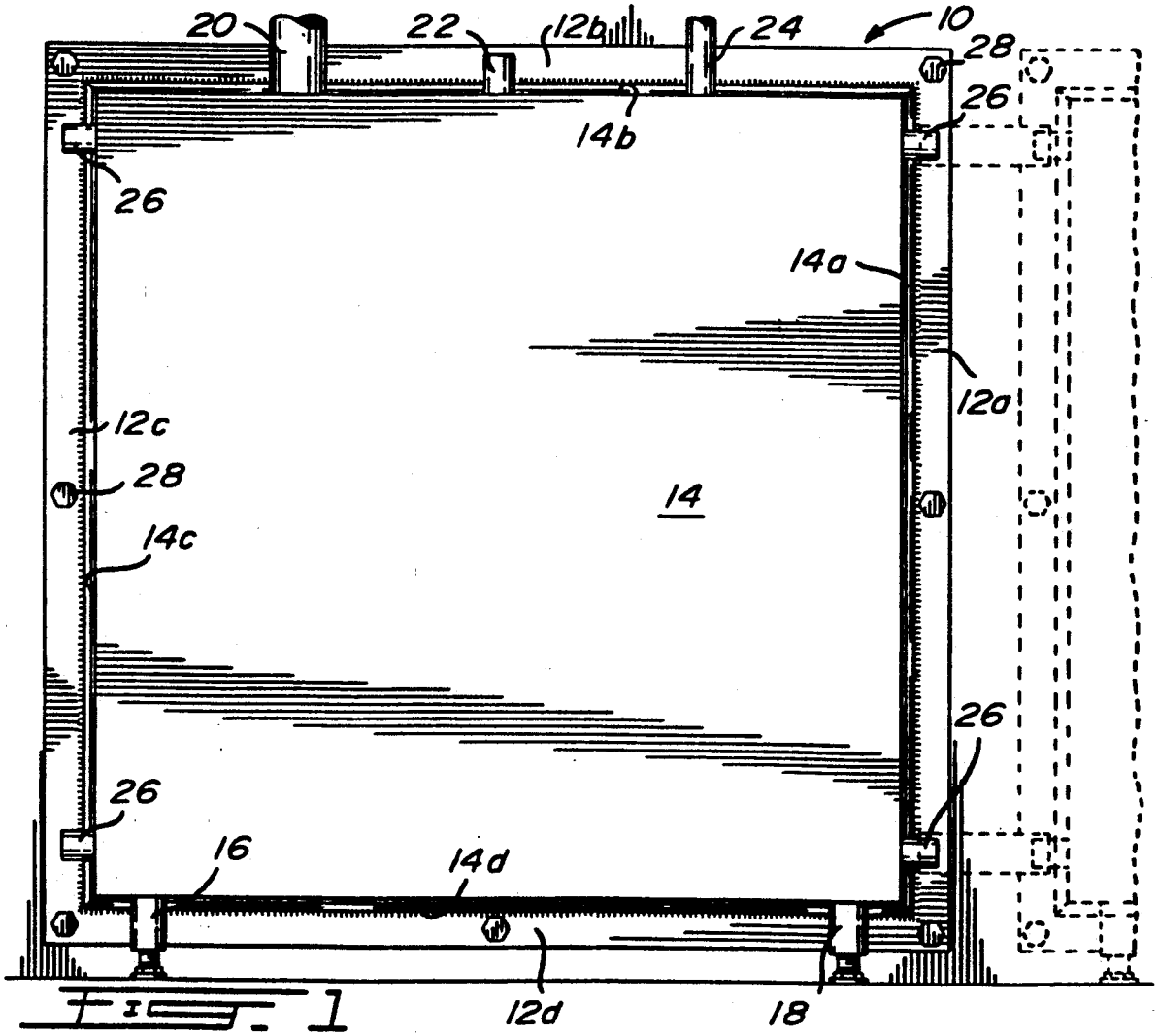
FIG. 1 is a front elevational view of an oil tank in accordance with the present invention.

Referring now to the drawings and in particular to FIGS. 1 and 2, there is shown an oil tank in accordance with the present invention which includes a narrow vessel made up of planar wall panels 12 and 14. A flange 12*a*, 12*b*, 12*c*, and 12*d* is provided about the oil tank 10 in the plane of the side wall 12.

A method of construction of the tank 10 would be to provide a first steel panel 12 cut out to the dimensions of the rear wall 12 with its flanges 12*a*, 12*b*, 12*c*, and 12*d*. A further steel panel 14 is then formed with end walls 14*a*, 14*c*, top wall 14*b* and bottom wall 14*d*. These end walls 14*a* and 14*c* as well as top wall 14*b* and bottom wall 14*d* are welded to the steel panel representing the rear wall 12. Openings are provided in the flanges 12*a*, 12*b*, 12*c*, and 12*d* to receive fasteners, such as screws 28, to mount the tank to a building wall W.

Legs 16 and 18 are provided on the bottom wall 14*d*. Legs 16 and 18 are adjustable screw-type legs and are forward of the bottom wall 14*d* adjacent the front wall 14. Various outlets and inlets denoted by numeral 26 may be provided in order to connect the oil tank 10 to other similar oil tanks 10 in series as shown in FIG. 3 and to the furnace.

A fill tube 20 may be provided on the top wall 14*b* and may communicate with the outside of the building. A vent tube 24 may also be provided on the top wall 14*b*, and a fitting for a level indicator is identified at 22.

A typical oil tank 10 having a 100-gallon capacity might have a width of 6 feet and a height of 6 feet but an overall depth of 6 inches. It is contemplated that the depth of the tank, that is, the outer dimensions between the front wall 14 and the rear wall 12, would be anywhere from 4 inches to 12 inches while the height of the tank may be anywhere from 3 feet to 8 feet. The capacity of the tank would typically be 100 gallons although it could range anywhere from 50 to 200 gallons. However, it is contemplated that a plurality of smaller modular tanks 10 mounted in series be utilized rather than to fabricate oversized tanks. Thus, if a 400-gallon capacity reservoir is required, four 100-gallon capacity tanks may be provided or eight 50-gallon tanks in series, all mounted against building walls W. In order to save space, the oil tank 10 is designed to be mounted for stability to the wall of a basement room, for instance, and screws 28 are provided to extend through the openings provided in flanges 12*a*, 12*b*, 12*c*, and 12*d*. However, the tank would be mainly supported by the legs 16 and 18.

Figure 3:
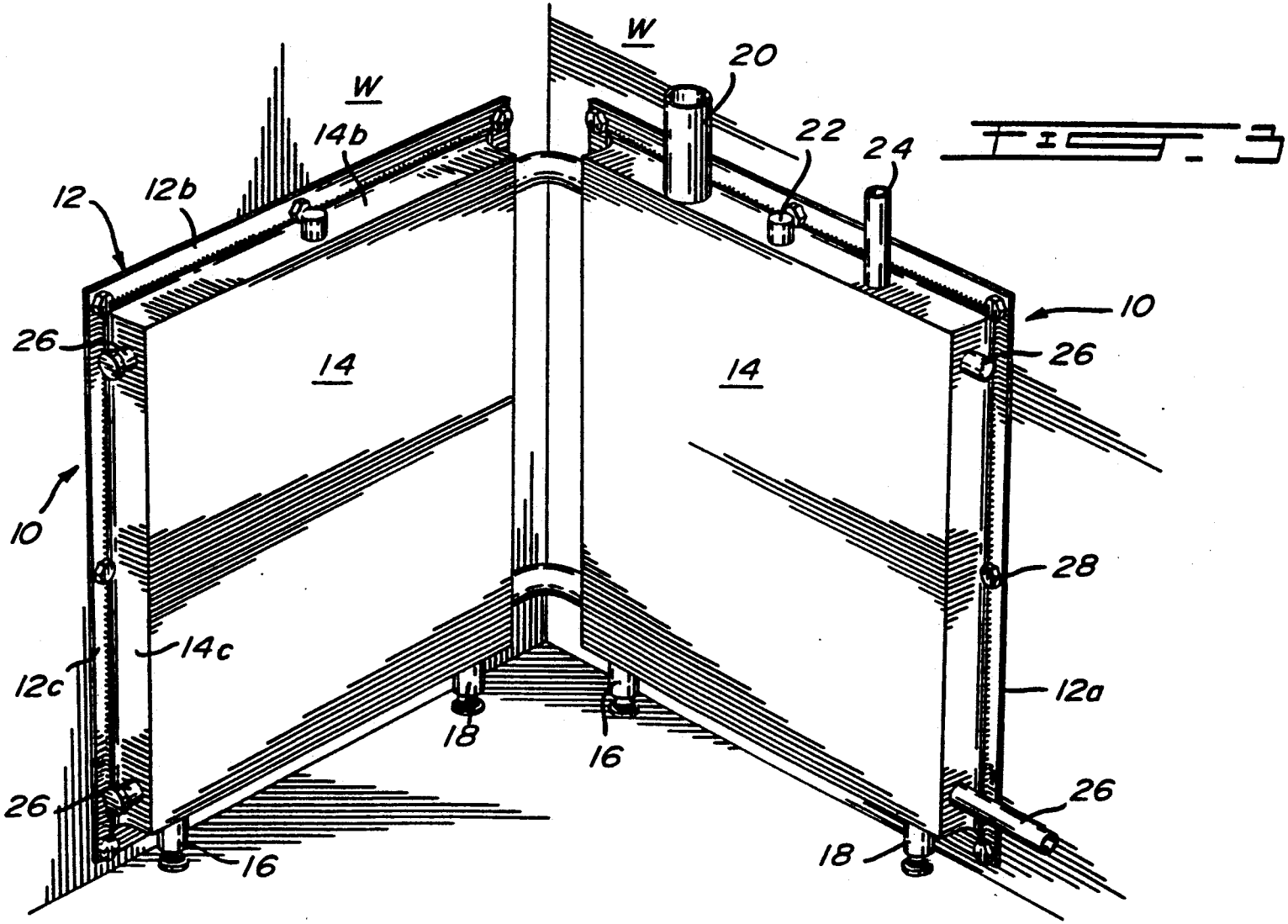
FIG. 3 is a perspective view showing two oil tanks in accordance with the present invention mounted in series on building walls.

As shown in FIG. 3, two modular tanks 10 are mounted to adjoining walls W near a corner in a room. It is contemplated, for instance, that the tank 10 may be mounted to a bare basement wall and a dry wall might be mounted against the front wall 14 of the tank to completely hide the oil tank behind the dry wall. It is also contemplated that front panel 14 could be adapted to receive a decorative panel which might have different surface finishes.

I claim:

1. A fuel tank for mounting on a building wall including an upstanding vessel having parallel planar front and rear walls; bottom, end and top walls joining the parallel planar front and rear walls, wherein the outside dimensions between the front and rear walls is in the range of 4 to 12 inches and the outside dimensions between the top and bottom walls is between 3 feet and 8 feet, while the capacity of the tank is between 50 to 200 gallons, the rear wall being provided with flanges extending in the same plane as the rear wall, at least a pair of legs provided on the bottom wall near the front wall for supporting the vessel when the vessel is mounted with the rear wall adjacent the building wall, and fastener means for joining the flange to the building wall such that in use the vessel is mounted to the building wall supported partly by the legs.

2. A liquid reservoir as defined in claim 1, wherein the vessel is an oil tank for use with domestic oil-fired appliances in a building.

3. A liquid reservoir as defined in claim 1 wherein the outside dimensions of the tank between the end walls is approximately 6 feet while the outside dimension between the top and bottom walls is approximately 6 feet, and the outside dimension between the front and rear walls is approximately 6 inches while the capacity of the reservoir is 100 gallons.

* * * * *